US010749297B2

(12) United States Patent
Dobler

(10) Patent No.: US 10,749,297 B2
(45) Date of Patent: Aug. 18, 2020

(54) ELECTRICAL PLUG-IN CONNECTION FOR DATA TRANSMISSION

(71) Applicant: Neutrik AG, Schaan (LI)

(72) Inventor: Oliver Dobler, Ruggell (LI)

(73) Assignee: NEUTRIK AG, Schaan (LI)

( * ) Notice: Subject to any disclaimer, the term of this patent is extended or adjusted under 35 U.S.C. 154(b) by 0 days.

(21) Appl. No.: 16/199,577

(22) Filed: Nov. 26, 2018

(65) Prior Publication Data

US 2019/0173231 A1 Jun. 6, 2019

(30) Foreign Application Priority Data

Dec. 1, 2017 (DE) ..... 10 2017 128604

(51) Int. Cl.
*H01R 13/73* (2006.01)
*H01R 13/639* (2006.01)
(Continued)

(52) U.S. Cl.
CPC ..... *H01R 13/6395* (2013.01); *H01R 13/5845* (2013.01); *H01R 13/6275* (2013.01);
(Continued)

(58) Field of Classification Search
CPC .. H01R 13/6658; H01R 13/6275; H01R 9/03; H01R 13/6272; H01R 13/745; H01R 13/658
(Continued)

(56) References Cited

U.S. PATENT DOCUMENTS 3,149,897 A * 9/1964 Martineck ..... H01R 12/774 439/494
3,737,833 A * 6/1973 Jerominek ..... H01R 12/592 439/61
(Continued)

FOREIGN PATENT DOCUMENTS

| | | |
|---|---|---|
| DE | 2017063005 | 4/2017 |
| FR | 2923660 | 5/2009 |
| WO | 2017063005 | 4/2017 |

OTHER PUBLICATIONS

"Quick Lock USB 3.0 Receptacle A90004-801", OMNETICS Connector Corp, Minneapolis, MN, www.omnetics.com, 1 pg. (admitted prior art), Jan. 2016.
(Continued)

*Primary Examiner* — Thanh Tam T Le
(74) *Attorney, Agent, or Firm* — Volpe and Koenig, P.C.

(57) ABSTRACT

An electrical plug-in connection (1) for data transmission, including a plug (2) and a socket (3), the plug (2) has a plug housing (4) and a plug-in extension (5) which projects beyond the plug housing (4) and has electrical contacts (6), and the socket (3) has a socket housing (7) with a receiving channel (8) for the plug housing (4). A plug-in extension receptacle (9) with electrical mating contacts (10) is provided, and in a fully inserted state, the plug-in extension (5) is inserted into the plug-in extension receptacle (9) for connecting the electrical contacts (6) to the electrical mating contacts (10). The plug housing (4), at least in regions, is arranged within the receiving channel (8). The socket (3) has a locking device (11) for locking the plug housing (4) in the receiving channel (8) in the fully inserted state and an operating element (12), which projects beyond the socket housing (7), for releasing this locking arrangement.

12 Claims, 5 Drawing Sheets

(51) Int. Cl.

| | |
|---|---|
| ***H01R 13/627*** | (2006.01) |
| ***H01R 13/58*** | (2006.01) |
| *H01R 13/66* | (2006.01) |
| *H01R 13/187* | (2006.01) |
| *H01R 12/70* | (2011.01) |
| *H01R 24/76* | (2011.01) |

(52) U.S. Cl.
CPC ..... *H01R 12/7029* (2013.01); *H01R 13/187* (2013.01); *H01R 13/6658* (2013.01); *H01R 24/76* (2013.01)

(58) Field of Classification Search
USPC ..... 439/350–352, 357–358, 76.1, 550, 565, 439/607.44, 607.45, 607.46
See application file for complete search history.

(56) References Cited

U.S. PATENT DOCUMENTS

| | | | | |
|---|---|---|---|---|
| 4,445,742 | A * | 5/1984 | Fullam | H01R 13/112 439/260 |
| 4,917,625 | A * | 4/1990 | Haile | H01R 13/639 439/358 |
| 4,921,442 | A * | 5/1990 | Puerner | H01R 12/777 439/499 |
| 5,154,629 | A * | 10/1992 | Carver | G02B 6/3817 439/352 |
| 5,564,939 | A * | 10/1996 | Maitani | H01R 13/6335 439/352 |
| 6,132,234 | A * | 10/2000 | Waidner | H01R 13/6273 439/358 |
| 6,585,536 | B1 * | 7/2003 | Wu | H01R 13/6275 439/358 |
| 6,655,979 | B1 * | 12/2003 | Lee | H01R 13/6275 439/357 |
| 6,769,927 | B2 * | 8/2004 | Brewer | H01R 12/721 439/328 |
| 6,776,646 | B2 * | 8/2004 | Lee | H01R 13/6275 439/357 |
| 6,866,543 | B2 * | 3/2005 | Chen | H01R 43/16 439/541.5 |
| 6,953,356 | B2 * | 10/2005 | Hisamatsu | H01R 13/6273 439/258 |
| 6,991,494 | B1 * | 1/2006 | Spink, Jr. | H01R 13/745 439/607.27 |
| 7,008,253 | B2 * | 3/2006 | Szczesny | H01R 13/6275 439/352 |
| 7,484,989 | B2 * | 2/2009 | Venaleck | H01R 13/6275 439/352 |
| 7,815,460 | B2 * | 10/2010 | Lin | H01R 9/03 439/358 |
| 8,092,246 | B1 * | 1/2012 | Santiago | H01R 13/6275 439/357 |
| 8,162,687 | B2 | 4/2012 | Dawiedczyk et al. | |
| 8,303,326 | B1 * | 11/2012 | McKee | H01R 13/6275 439/358 |
| 8,449,314 | B1 * | 5/2013 | Feist | H01R 13/512 439/358 |
| 9,039,455 | B2 | 5/2015 | Hsieh | |
| 9,832,556 | B2 * | 11/2017 | Akino | H04R 1/04 |
| 2010/0151720 | A1 | 6/2010 | Lin | |
| 2016/0373845 | A1 | 12/2016 | Akino | |

OTHER PUBLICATIONS

"Amphenol LTW", USB Type C to USB3.0 type A Plug, 1 pg., dated Aug. 15, 2017.
Azom.com/images/Article_Images/ImageForArticle_13969(6).jpg, 1 pg., downloaded Oct. 5, 2017.
"Quick Lock USB 3.0 Plug A9000-801", OMNETICS Connector Corp, Minneapolis, MN, www.omnetics.com, 1 pg. (admitted prior art), Jan. 2016.
"Quick Lock USB 3.0 Receptacle Panel Mount A90002-801", OMNETICS Connector Corp, Minneapolis, MN, www.omnetics.com, 1 pg. (admitted prior art), Jan. 2016.
"Quick Lock USB 3.0 Receptacle A90001-801", OMNETICS Connector Corp, Minneapolis, MN, www.omnetics.com, 1 pg. (admitted prior art), Jan. 2016.
"Quick Lock USB 3.0 Receptacle A90003-801", OMNETICS Connector Corp, Minneapolis, MN, www.omnetics.com, 1 pg. (admitted prior art), Jan. 2016.
displaydaily.com/images/2016/July/typecusb.png, downloaded, 1 pg., Oct. 5, 2017.
"Amphenol LTW", USB 3.1 Type C Jack. p. 1 of 2., dated Oct. 21, 2016.
"Amphenol LTW, USB 3.1 Type C Jack", p. 2 of 2, Oct. 21, 2016.

* cited by examiner

ELECTRICAL PLUG-IN CONNECTION FOR DATA TRANSMISSION

INCORPORATION BY REFERENCE

The following documents are incorporated herein by reference as if fully set forth: German Patent Application No. DE102017128604.7, filed Dec. 1, 2017.

BACKGROUND

The present invention relates to an electrical plug-in connection for data transmission, comprising a plug and a socket, wherein the plug has a plug housing and a plug-in extension which projects beyond the plug housing and has electrical contacts, and the socket has a socket housing with a receiving channel for the plug housing, and the plug-in connection has a plug-in extension receptacle with electrical mating contacts, wherein, in a fully inserted state, the plug-in extension is inserted into the plug-in extension receptacle for the purpose of connecting the electrical contacts to the electrical mating contacts, and the plug housing, at least in regions, is arranged within the receiving channel.

Electrical plug-in connections of the said type are known, for example, from WO 2017/063005 A1. In the said document, the socket housing is arranged in a recessed manner directly in the housing of an electrical device. The plug housing of the cable plug which is inserted into this socket is held with a friction fit given a correspondingly small amount of play between the plug and socket housing.

Other measures for securing the plug housing in the socket against being pulled out which are known by prior public use include screw arrangements or else locking devices with pivotable locking levers on the plug housing.

SUMMARY

The object of the invention is to provide a robust electrical plug-in connection of the above-mentioned type in which the plug is secured against being pulled out of the socket.

According to the invention, this is achieved by way of the socket having a locking device for the purpose of locking the plug housing in the receiving channel in the fully inserted state and an operating element, which projects beyond the socket housing, for releasing this locking arrangement.

A basic idea of the invention is therefore to design the locking device as part of the socket and to arrange the said locking device in such a way that it locks the plug housing in the receiving channel, that is to say within a region of the socket housing, when the plug housing, in the fully inserted state, is located correspondingly far in the receiving channel.

The locking arrangement can be released by the operating element which projects out of the socket housing, in order to in this way pull the plug housing and therefore the plug out of the socket again. The operating element expediently has an operating surface which is accessible from the outside and can be operated by hand. The operating element is preferably mounted in a linearly displaceable manner in or on the socket housing. In order to linearly displace the operating element in the socket housing or relative to the socket housing, it is expediently sufficient to simply press on the operating element. The operating element can be returned by a corresponding spring pre-stress. In preferred refinements, this spring pre-stress can be achieved by the locking device itself, preferably by elastic locking arms of the locking apparatus, as will be described in more detail further below. Provision is preferably made for the plug housing, on its outer face, to have at least one notch, preferably in each case one notch on mutually opposite sides, for the engagement of the locking device for the purpose of locking the plug housing in the receiving channel in the fully inserted state. For the purpose of a very robust configuration which is susceptible to as few faults as possible, preferred variants make provision for the notch or the notches of the plug housing to be arranged within the receiving channel in the fully inserted state.

In preferred variants, the locking device has at least one locking arm which is mounted in or on the socket housing in a movable manner and can be operated by the operating element and engages into the notch or one of the notches of the plug housing for locking purposes. This locking arm is preferably mounted in or on the socket housing in a pivotable manner. It particularly preferably has an elastic design. To this end, the locking arm itself can be elastically deformable, for example in the form of a spring arm. However, it is also conceivable to elastically pre-stress the locking arm by a separate spring. This is both possible when the locking arm is linearly movable and pivotable.

Provision is particularly preferably made for the locking device to have at least two locking arms which are mounted in or on the socket housing in a movable manner and can be operated by the operating element and each engage into in each case one of the notches of the plug housing for locking purposes. Here, the notches are expediently arranged on mutually opposite sides of the plug housing. Preferred variants make provision for the locking device to have precisely two locking arms of this kind. These locking arms are also, generally speaking, movable. Therefore, they can also be linearly displaceable. However, the said locking arms are preferably once again pivotably mounted locking arms. The elastic pre-stress of the locking arms is also particularly preferably once again directed in the direction of the locking position here. This can once again be realized by locking arms, in the form of locking springs, which are inherently elastic themselves or else by correspondingly elastically pre-stressed locking arms which are inherently rigid.

The locking arms can be arranged in a V-shaped manner relative to one another, so that together they form a V shape. Provision is particularly preferably made for both locking arms to be able to be operated by the one operating element. This can be realized, for example, by way of a linearly displaceable operating element being able to be pushed into the opening between two locking arms which are arranged in a V-shaped manner in order to pivot the said locking arms further apart, preferably against their elastic pre-stress.

The plug is expediently a cable plug which is fastened or is to be fastened to a cable. In principle, the socket can also be fastened or fastenable to a cable. However, provision is preferably made for the socket to be a chassis socket which is fastened or is to be fastened to a housing of a device. Provision is preferably made here for the socket to have a mounting flange for the purpose of fastening the socket to a housing of a device. The operating element preferably passes through this mounting flange. The plug-in extension receptacle is in principle part of the plug-in connection. It can also be part of the socket, for example by way of being fixedly fastened to the socket housing or integrated into the said socket housing. However, the plug-in extension receptacle can also be a separate part of the electrical plug-in connection. Provision can be made for the socket to be directly or indirectly fastened to a printed circuit board, wherein the plug-in extension receptacle can then also be fastened on the printed circuit board with corresponding positioning relative to the socket. Particularly preferred variants make provision for a carrier card, which is arranged at a distance from the printed circuit board, to be arranged on the printed circuit board and for the plug-in extension receptacle to be arranged on the carrier card.

Electrical plug-in connections according to the invention are electrical plug-in connections for data transmission, that is to say for electrically transmitting information or data. However, the electrical plug-in connections according to the invention can also be used for electrical power transmission or in other words for supplying power to a device.

The electrical plug-in connections according to the invention are particularly preferably a USB plug-in connection, particularly preferably a USB type C plug-in connection. Here, USB is a generally known standard. USB is an abbreviation for Universal Serial Bus. By use of the invention, USB plug-in connections of this kind can be designed in a very robust manner and secured against the plug being unintentionally pulled out of the socket.

BRIEF DESCRIPTION OF THE DRAWINGS

Further features and details of preferred refinements of the invention will be explained below in the description of the figures with reference to preferred exemplary embodiments of the invention. In the drawings.

DETAILED DESCRIPTION

In principle, electrical plug-in connections 1 according to the invention can be designed very differently. However, in the exemplary embodiments shown here, the electrical plug-in connections according to the invention are all so-called USB plug-in connections, especially USB type C plug-in connections which meet the appropriate USB standard here.

Figure 1:
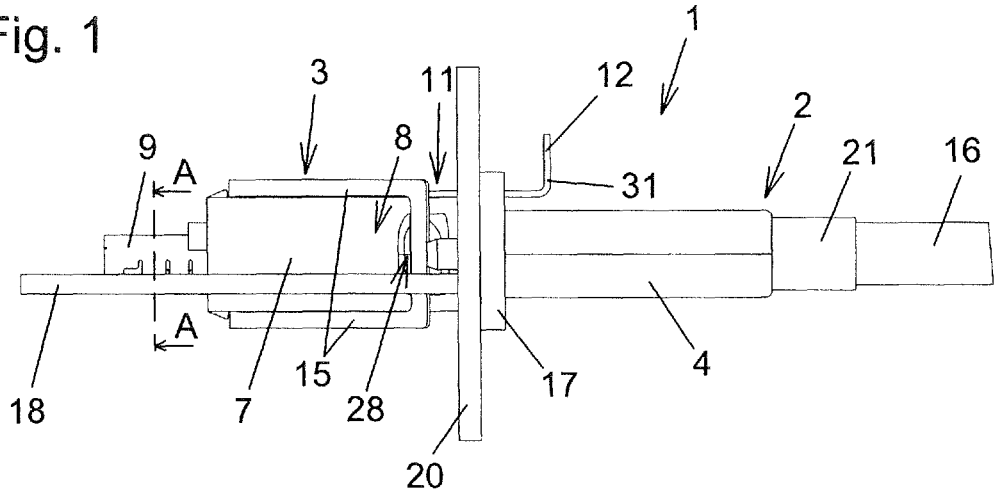
FIG. 1 shows a side view of a first exemplary embodiment of an electrical plug-in connection according to the invention.

The exemplary embodiments of the electrical plug-in connection 1 according to FIG. 1 on the one hand and FIGS. 11 to 14 on the other differ essentially by way of the manner in which the socket 3 of the electrical plug-in connection 1 and the plug-in extension receptacle 9 of the electrical plug-in connection 1 are arranged on a printed circuit board 18. The features, discussed on the basis of FIGS. 2 to 10, of the preferred design variants, shown here, of a socket 3 and a plug 2 apply both for the variant according to FIG. 1 and also for the variant according to FIGS. 11 to 14.

In FIG. 1, the plug-in extension receptacle 9, which is not a fixed constituent part of the socket 3 in the exemplary embodiments shown here, is fastened directly on a printed circuit board 18, indicated only schematically here. An appropriate recess of the printed circuit board 18 is created for the socket 3 of the electrical plug-in connection 1 according to the invention, so that the socket 3 can be arranged and fastened on the printed circuit board 18 in the position shown in FIG. 1, so that the plug-in extension 5 of the plug 2, which is fully inserted into the socket 3, is arranged in the plug-in extension receptacle 9.

As an alternative, it is of course also possible to design the plug-in extension receptacle 9 directly as part of the socket 3.

In the exemplary embodiment shown, the socket 3 has a socket housing 7 and a mounting flange 17 which are fixedly connected to one another. The socket housing 7 contains the receiving channel 8 into which the plug housing 4, over part of its longitudinal extent, can be inserted and also can be locked. In the fully inserted state, as is shown in FIGS. 1 and 3 to 6 and also 9, 10, 11, 12 and 13, the plug housing 4 of the plug 2, over part of its longitudinal extent, is arranged within the receiving channel 8. The socket 3 is fastened to a housing 20 of an electrical device by the mounting flange 17 such that the plug 2 can be inserted into the receiving channel 8 of the socket 3 from the outside. FIG. 1 shows only a detail of a panel of the housing 20 of the device. In the first exemplary embodiment, the socket is mounted on this housing 20 or the panel shown here such that the mounting flange 17 bears against the outside of the housing 20 and the socket housing 7 passes through a corresponding opening in the housing 20 of the device and, for the most part, is arranged within the housing 20. This manner of mounting sockets 3 on panels or on housings 20 of electrical devices is known per se and does not need to be explained further. In the exemplary embodiments shown here, the socket 3 is, in every case, a chassis socket which is fastened or is to be fastened to a housing 20 of a device and has the mounting flange 17 for fastening the socket 3 to the housing 20. In a departure from this, corresponding sockets 3 could also be fastened to a cable.

The plug 2, shown here, of the electrical plug-in connection 1 according to the invention is a cable plug which is fastened to a cable 16 in all of the exemplary embodiments shown here. In order to prevent kinking of the cable 16 at the outlet out of the plug housing 4, a cable sleeve 21, which however could of course also be left out in principle, is provided in the exemplary embodiments shown here in a manner which is known per se.

According to the invention, in all of the exemplary embodiments shown here, the socket 3 of the electrical plug-in connection 1 has a locking device 11 for the purpose of locking the plug housing 4 in the receiving channel 8 in the fully inserted state. In other words, the locking device 11 locks the plug housing 4 in the region of the receiving channel 8. In the mounting of the sockets 3 on the housings 20 of the electrical devices realized in the exemplary embodiments shown here, the site of the locking arrangement, that is to say the site at which the locking device 11 acts on the plug housing 4, is situated in the region of the receiving channel 8 and therefore of the socket housing 7 and therefore generally within the respective housing 20 of the respective electrical device. In addition, according to the invention, the socket 3 has an operating element 12, which projects beyond the socket housing 7, for the purpose of releasing this locking arrangement. In the exemplary embodiments shown, the fastening element 12 passes through the mounting flange 17 and, in the preferred refinements, also the housing 20, so that the operating element 12 can be accessible from the outside and can be operated by hand. In all of the exemplary embodiments shown here, the operating element 12 is a slide. The operating element 12 is mounted in a linearly displaceable manner in or on the socket housing 7. The design and manner of operation of the locking device 11 of these exemplary embodiments shown here and its interaction with the operating element 12 will be explained in more detail further below.

Figure 2:
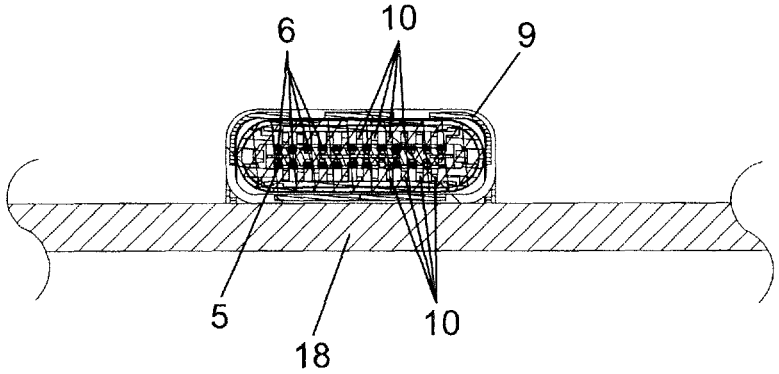
FIG. 2 shows the section along section line AA from FIG. 1 through the plug-in extension receptacle with the plug-in extension inserted.

FIG. 2 shows the section along section line AA through the plug-in extension receptacle 9 into which the plug-in extension 5 of the plug 2 is inserted in the fully inserted state. In this fully inserted state, the electrical contacts 6 on the plug-in extension 5 are in electrically conductive contact with the electrical mating contacts 10 of the plug-in extension receptacle 9, so that both data and possibly also electrical power can be transmitted by the electrical contacts 6 and the electrical mating contacts 10 and therefore by the electrical plug-in connection 1. The design of the plug-in extension 5 and the plug-in extension receptacle 9 is a connection which follows the USB standard and especially the USB type C standard here, and therefore this does not need to be explained further. However, in principle, the plug-in extension 5 and then the correspondingly matching plug-in extension receptacle 9 could of course also be designed differently.

Figure 3:
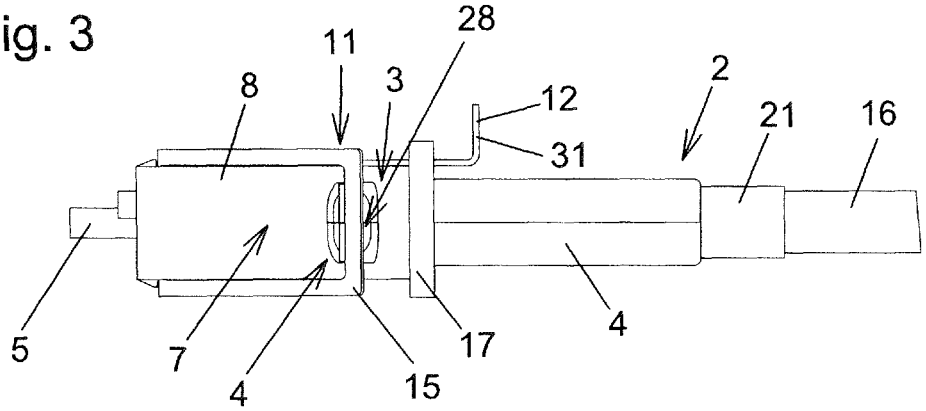
FIGS. 3 to 5 show the plug and the socket from FIG. 1 in the fully inserted state in different views with a closed locking arrangement.
Figure 4:
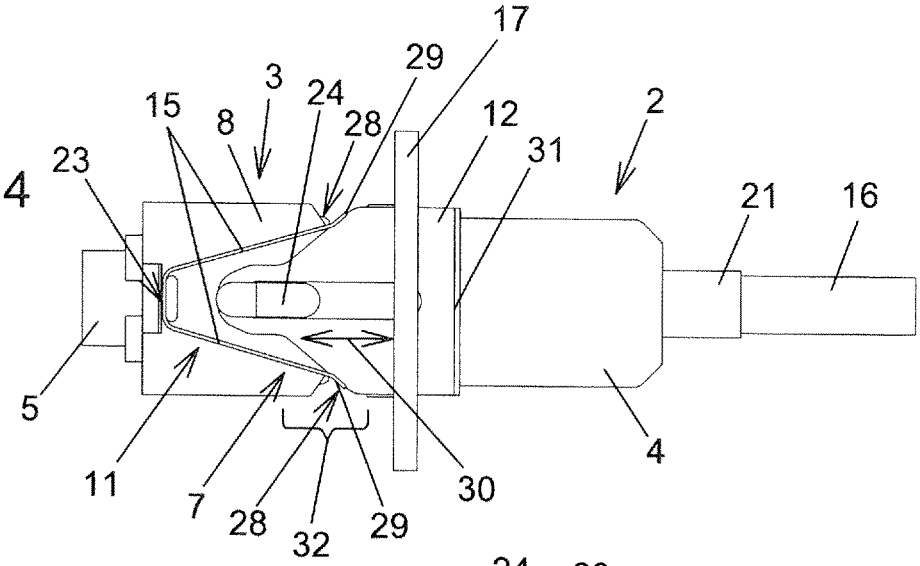
Figure 5:
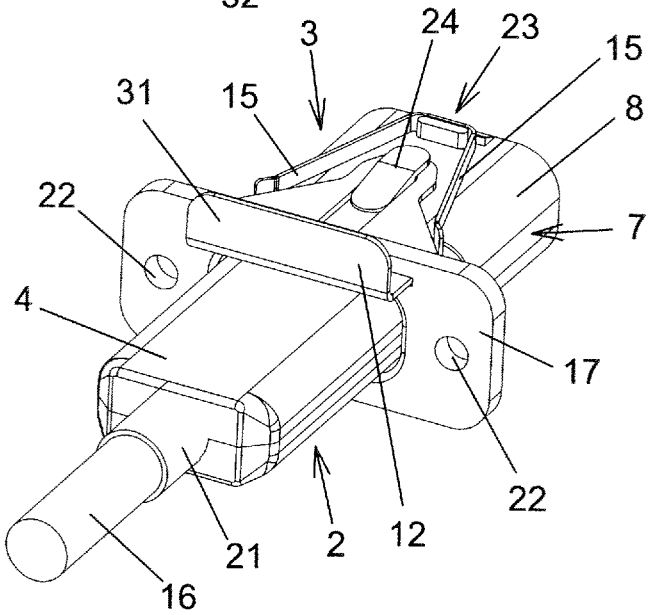

FIGS. 3, 4 and 5 show the socket 3 and plug 2 used in all of the exemplary embodiments of an electrical plug-in connection 1 shown here, wherein the plug 2 is fully pushed into the receiving channel 8 of the socket housing 7 in all of FIGS. 3, 4 and 5, so that the plug-in extension 5 projects at the rear end of the socket housing 7 to such an extent that it can be inserted into the plug-in extension receptacle 9, not illustrated in FIGS. 3, 4 and 5, for the purpose of contact-connecting the electrical contacts 6 to the electrical mating contacts 10.

Figure 6:
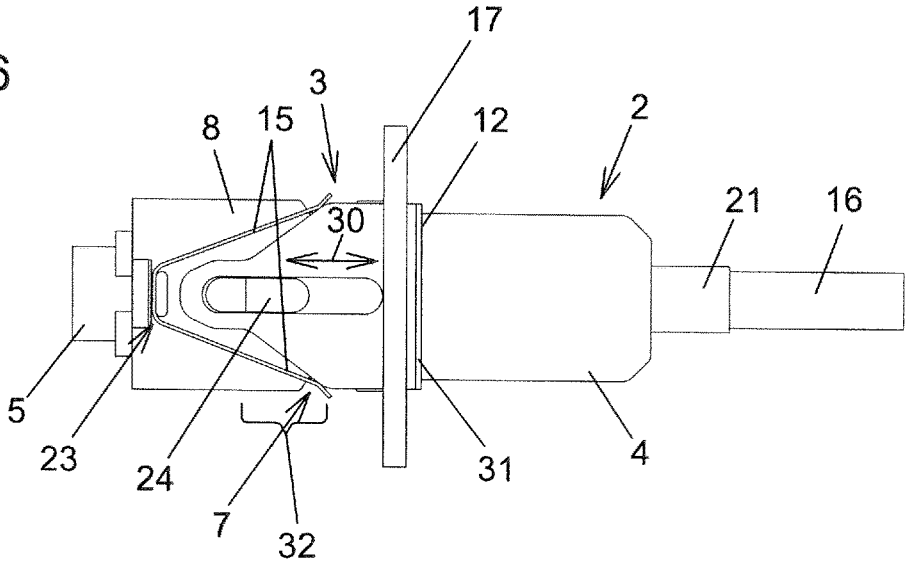
FIG. 6 shows a view which corresponds to FIG. 4, but in the unlocked state.

In FIGS. 3, 4 and 5, the locking device 11 is in the locking state in which it firmly holds the plug 2 in the socket 3 by corresponding engagement into the plug housing 4. FIG. 6 shows an illustration which is otherwise analogous to FIG. 4. The only difference therein is that the locking by the locking device 11 is released by the operating element 12 in FIG. 6.

In the exemplary embodiments shown, the locking device 11 has two locking arms 15 which are pivotably mounted on the socket housing 7 and can be operated by the operating element 12. In the exemplary embodiments shown here, the said locking arms are of U-shaped form us, for locking purposes or in the locked state, engage in each case into one of the notches 14 which are arranged on mutually opposite sides of the plug housing 4. These notches 14 in the outer faces 13 of the plug housing 4 can be seen particularly clearly in FIG. 7. In the exemplary embodiment shown here, the locking arms 15 are inherently elastically designed as spring arms and fastened to the socket housing 7 in a pivotable manner by the fixing arrangement 23. The locking arms 15 realized in this preferred exemplary embodiment are arranged in a V-shaped manner. In the exemplary embodiments shown here, both locking arms 15 can be operated by one single operating element 12. The ends 29, which are provided for the purpose of engaging into the notches 14 of the plug housing 4, of the locking arms 15, which are each of U-shaped design in these exemplary embodiments here, engage into corresponding openings 28 in the socket housing 7 in the locked state.

The operating element 12 is mounted on the socket housing 7 in a linearly displaceable manner for the purpose of releasing the locking arrangement. In the exemplary embodiment specifically shown here, this displaceable mounting is realized by the linear guide 24 on the socket housing 7. In preferred exemplary embodiments, like that shown here, the operating element 12 can be moved back and forth between its end positions according to FIG. 4 and FIG. 6 only linearly in the directions 30. In order to move the locking arms 15, which are arranged in a V-shaped manner, of the examples shown here from the locking position according to FIG. 4 to the locked position according to FIG. 6, the operating element 12 can be designed in a wedge-shaped manner in regions, as is also realized here. In the exemplary embodiment shown, the operating element 12 has the wedge-shaped section 32 for this purpose. The operating face 31 of the operating element 12 is expediently situated outside the socket housing 7 and—if present—also the mounting flange 17 and is accessible from the outside. As is also realized here, the elements and operating faces are particularly preferably operating elements 12 or operating faces 31 which can be operated by hand and without tools. In the exemplary embodiment shown here, operation is performed by pressing on the operating face 31 using a finger, as a result of which the operating element 12 is displaced from the position according to FIG. 4 to the position according to FIG. 6. As a result, the operating element 12, by way of its wedge-shaped section 32, enters deeper into the region between the locking arms 15 which are arranged in a V-shaped manner, so that these locking arms 15 are pushed apart by the operating element 12 from the locked position according to FIG. 4 to the unlocked position according to FIG. 6. As a result, the ends 29 of the locking arms 15 are lifted out of the notches 14 of the plug housing 4 which is arranged in the receiving channel 8, so that the unlocked position in which the plug 2 can be pulled out of the socket 3 is achieved in FIG. 6. In the locked state, the locking device 11 prevents this pulling-out operation.

The operating element 12 is expediently automatically returned from the position according to FIG. 6 to the position according to FIG. 4 by elastic return forces as soon as the operating face 31 is released. In principle, a separate spring for pre-stressing the operating element 12 can be provided for this purpose. However, in preferred variants, as is shown here, provision is made for the operating element 12 to be elastically pre-stressed and therefore also returned by the locking device 11 as soon as the operating face 31 is released. In the exemplary embodiment shown here, this is specifically carried out by the locking arms 15 being elastically pre-stressed in the direction toward one another and therefore, by acting on the wedge-shaped section 32, sliding the operating element 12 back to the position according to FIG. 4 as soon as pressure is no longer applied to the operating face 31.

In a departure from the exemplary embodiment specifically shown here, the locking device 11 can in principle also have only one single locking arm 15. The locking arm or locking arms 15 also has/have to be mounted on the socket housing 7, not necessarily in a pivotable manner. They can also be mounted on the socket housing such that they can move in some other way, for example in a linearly displaceable manner. The locking arm or locking arms 15 do not have to be of inherently elastic design either. The elastic pre-stress of said spring arms, if provided at all, can also be realized by additional spring elements or the like.

Figure 7:
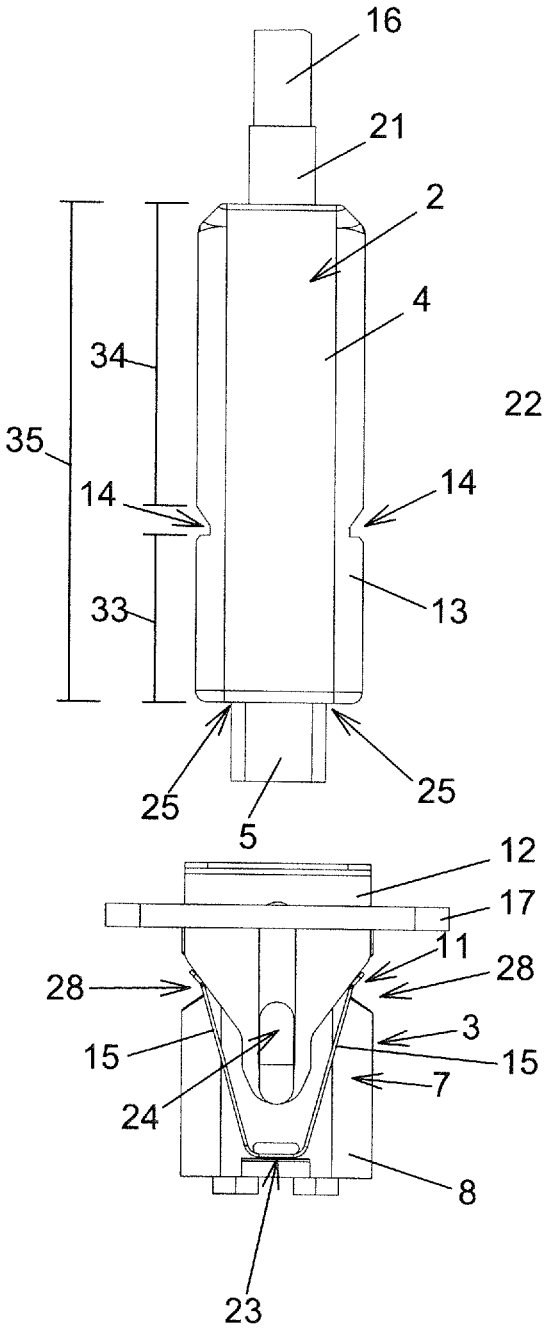
FIG. 7 shows the previously shown plug together with the socket in a state in which they are separated from one another.

FIG. 7 shows the plug 2 in a state in which it is pulled out of the socket 3. The elongate plug housing 4 and the plug-in extension 5, which projects out of the plug housing 4, can be clearly seen. The notches 14 which are arranged in the outer face 13 of the plug housing 4 can also be clearly seen. In the inserted state, the plug housing 4 can be pushed into the receiving channel 8 of the socket housing 7 to such an extent that the notches 14 are located in the receiving channel 8 and, in the exemplary embodiment specifically implemented here, are accessible through the opening 28, so that the locking arms 15, by way of their ends 29, can engage into the notches 14 for the purpose of locking the plug 2 in the socket 3. In the illustrated exemplary embodiment and also in other preferred exemplary embodiments, the plug housing 4, apart from the notches 14, is of substantially smooth design. In preferred refinements, like those shown here, there is a step or shoulder 25 between the plug housing 4 and the plug-in extension 5. The length 33 of the region of the plug housing 4 between the respective notch 14 and the said step or shoulder 25 expediently lies in the range of from 1 mm to 35 mm, preferably in the range of from 10 mm to 20 mm. The length 34 of the region between the respective notch 14 and the rear end of the plug housing 4, which end is opposite the plug-in extension 5, expediently lies in the range of from 5 mm to 70 mm, preferably in the range of from 10 mm to 30 mm. The total length 35 of the plug housing 4 from the shoulder or step 25 to the opposite end expediently lies in the range of from 15 mm to 90 mm, preferably of from 25 mm to 50 mm.

Figure 8:
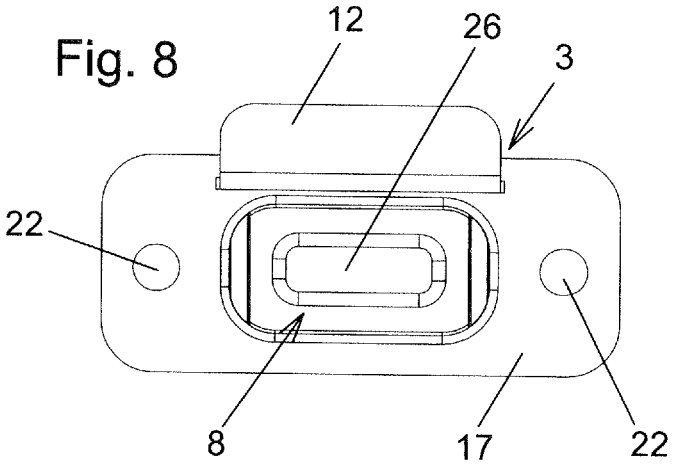
FIG. 8 shows a front view of the socket alone.

FIG. 8 shows a front view of the socket 3 and, in particular, the mounting flange 17 thereof. The mounting holes 22, by which the mounting flange 17 and therefore the socket 3 can be screw-connected to the housing 20 of an electrical device, can be clearly seen in the said figure. The mounting holes 22 can of course also be replaced by other fastening devices. FIG. 8 shows a view into the receiving channel 8 of the socket housing 7. The rear opening 26 of the socket housing 7, through which opening the plug-in extension 5 can be pushed in order to be inserted into the plug-in extension receptacle 9, can be clearly seen in the said figure.

Figure 9:
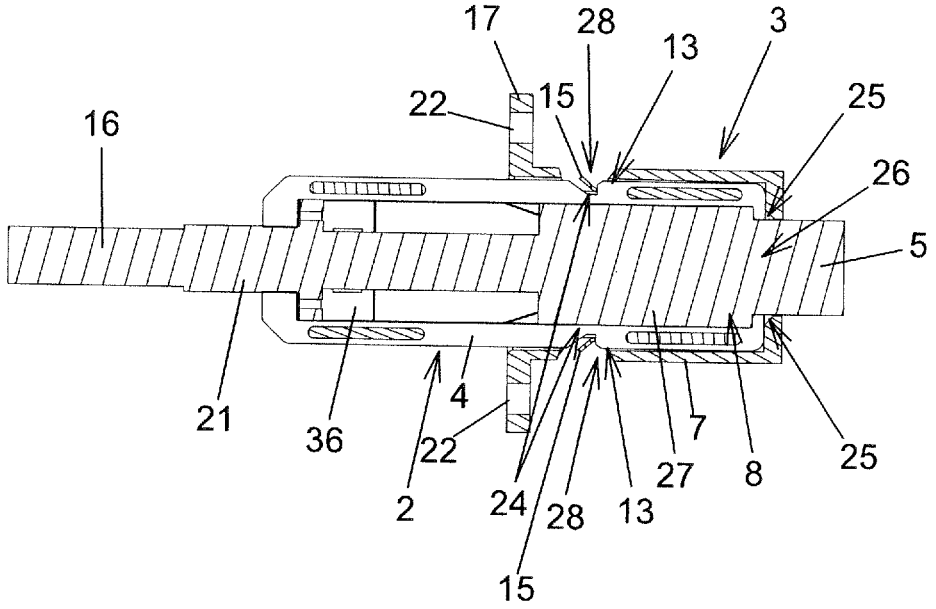
FIG. 9 shows a horizontal section through the arrangement according to FIG. 3.
Figure 10:
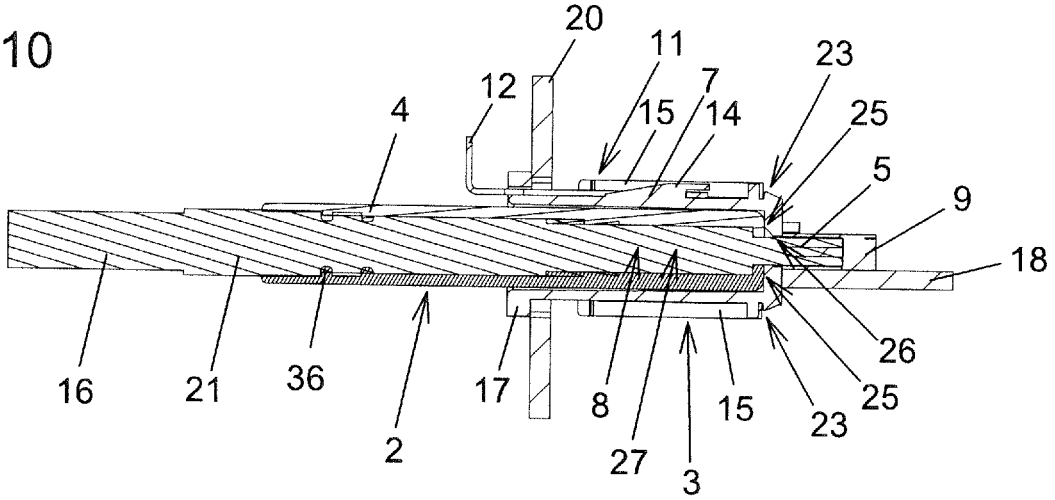
FIG. 10 shows a vertical section through the arrangement according to FIG. 1.
Figure 11:
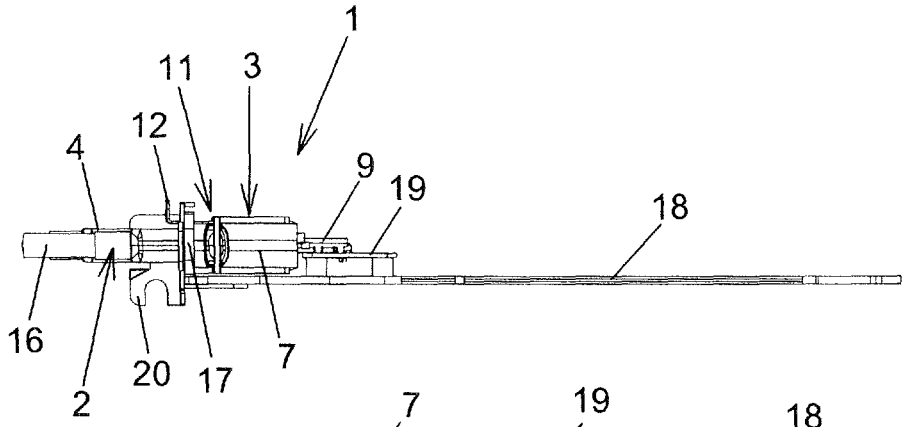
FIGS. 11 to 14 show various illustrations relating to a second design variant according to the invention of an electrical plug-in connection.
Figure 12:
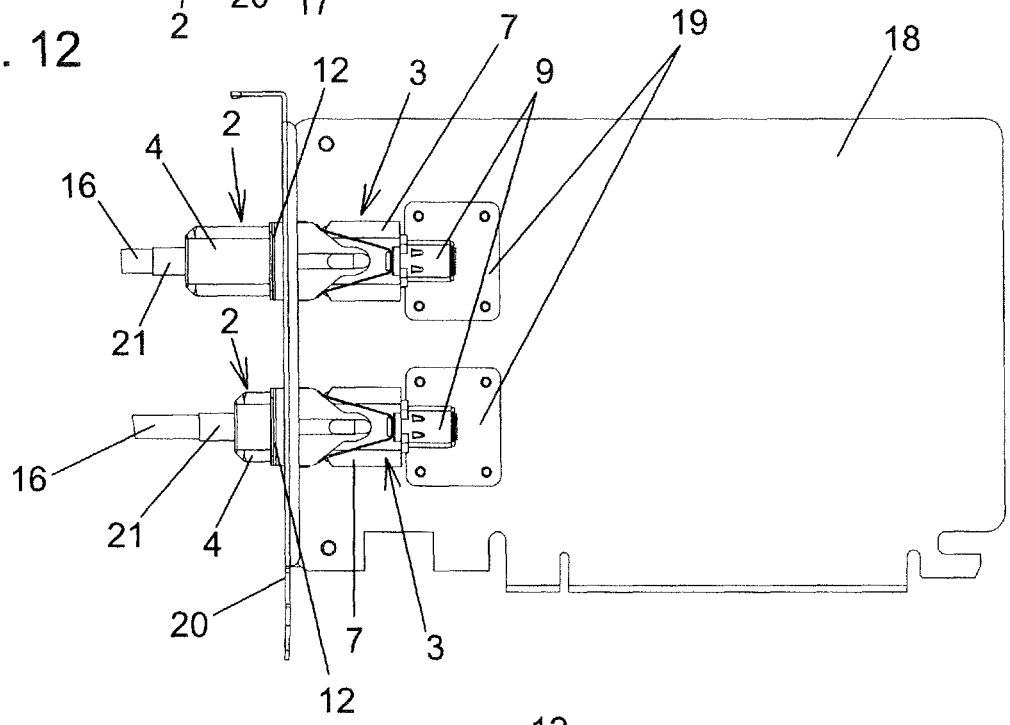

FIG. 9 shows a horizontal section through the plug 2, which is fully pushed into the receiving channel 8 of the socket 3, in the locked state, FIG. 10 shows a vertical section which is orthogonal to the said horizontal section, wherein the housing 20, the printed circuit board 18 and the plug-in extension receptacle 9 are additionally also illustrated in FIG. 10. In both FIGS. 9 and 10, the sections through the plug 2 and the cable 16 are illustrated only highly schematically since the internal parts of the plug 2 can ultimately be embodied in the manner already known per se in the prior art. As is known per se, the cable 16 is inserted into the plug housing 4 through the cable sleeve 21, also only schematically illustrated here. A strain-relief arrangement 36 protects the pre-mounted electronics system 27, designed in a manner which is known per se, against tensile loading by firmly holding the cable 16. In the exemplary embodiment shown here, the electronics system 27 can be embodied in accordance with the USB standard. The same applies for the contacts 6 of the plug-in extension 5 and also the mating contacts 10 of the plug-in extension receptacle 9.

Figure 13:
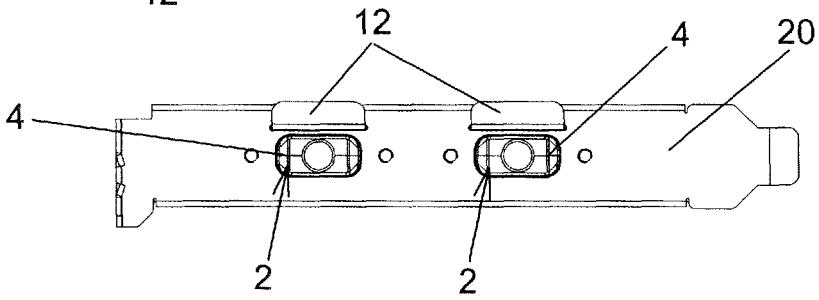
Figure 14:
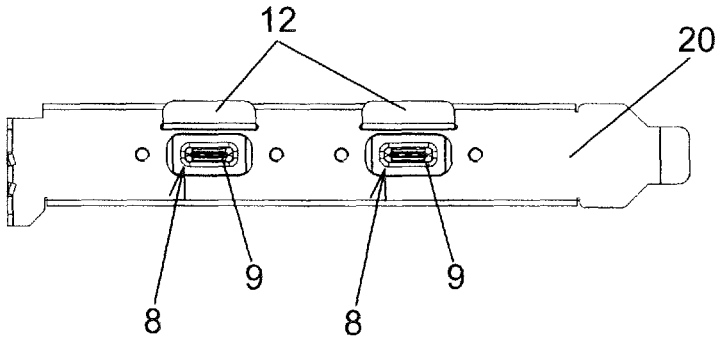

FIGS. 11 to 14 show a variant of an electrical plug-in connection 1 according to the invention in the form of a USB plug-in connection which is realized on a standard PCI card. The front panel of this PCI card, which is known per se, is considered to be part of the housing 20 here and is also designated as such. The essential difference from the embodiment according to FIG. 1 is that, here, the socket 3 is fastened horizontally on the printed circuit board 18 and that a carrier card 19, which is arranged at a distance from the printed circuit board 18, is provided on the printed circuit board 18, wherein the plug-in extension receptacle 9 is arranged on the carrier card 19. The fastening arrangement of the carrier card 19 on the printed circuit board 18 is a table-like construction, as can be seen particularly clearly in FIG. 11. The carrier card 19 and the printed circuit board 18 expediently run parallel to one another. This arrangement of the plug-in extension receptacle 9 at a distance relative to the printed circuit board 18 allows the socket 3 to be fastened on the printed circuit board 18 without a corresponding recess having to be provided in the printed circuit board. Otherwise, this exemplary embodiment according to FIGS. 11 to 14, in respect of its structure and in respect of its functioning, corresponds to the exemplary embodiment described up until now, and therefore reference can be made to the above explanations. FIG. 13 shows a front view of the panel designated as housing 20 here, wherein in each case one plug 2 is inserted into one socket 3. FIG. 14 shows the same view, but wherein the plugs 2 are not inserted, so that it is possible to see into the receiving channels 8 of the sockets 3.

KEY TO THE REFERENCE NUMERALS

1 Electrical plug-in connection
2 Plug
3 Socket
4 Plug housing
5 Plug extension
6 Contact
7 Socket housing
8 Receiving channel
9 Plug-in extension receptacle
10 Mating contact
11 Locking device
12 Operating element
13 Outer face
14 Notch
15 Locking arm
16 Cable
17 Mounting flange
18 Printed circuit board
19 Carrier card
20 Housing
21 Cable sleeve
22 Mounting hole
23 Fixing arrangement
24 Linear guide
25 Step
26 Rear opening
27 Electronics system
28 Opening
29 Ends
30 Direction
31 Operating face
32 Wedge-shaped section
33 Length
34 Length
35 Total length
36 Strain-relief arrangement

The invention claimed is:

1. An electrical plug-in connection for data transmission, comprising:

a plug having a plug housing and a plug-in extension which projects beyond the plug housing and has electrical contacts;

a socket having a socket housing that defines a receiving channel for the plug housing therein;

a plug-in extension receptacle with electrical mating contacts defined in the socket housing, the plug-in extension is inserted into the plug-in extension receptacle in a fully inserted state such that the electrical contacts are connected to the electrical mating contacts;

the plug housing, at least in regions, is arranged within the receiving channel in the fully inserted state;

a locking device provided on the socket that is configured to lock the plug housing in the receiving channel in the fully inserted state; and an operating element that projects beyond the socket housing and is configured to release said locking device;

wherein the plug housing includes an outer face that has two notches, with a respective one of the two notches being located on each of two mutually opposite sides of the plug housing, and the notches are configured for engagement of the locking device to lock the plug housing in the receiving channel in the fully inserted state.

2. The electrical plug-in connection according to claim 1, wherein the electrical plug-in connection is a USB plug-in connection.

3. The electrical plug-in connection according to claim 1, wherein the notches of the plug housing are arranged within the receiving channel in the fully inserted state.

4. The electrical plug-in connection according to claim 1, wherein the operating element is mounted in a linearly displaceable movement in or on the socket housing.

5. The electrical plug-in connection according to claim 1, wherein the locking device comprises at least one locking arm that is mounted in or on the socket housing in a movable manner and is operable by the operating element and engages into at least one of the notches to lock the plug into the socket.

6. The electrical plug-in connection according to claim 5, wherein the locking arm is elastically movable.

7. The electrical plug-in connection according to claim 5, wherein the at least one locking arm comprises at least two locking arms which are mounted in or on the socket housing in a movable manner, the at least two locking arms are operable by the operating element, and each of the locking arms engage into a respective one of the two notches to lock the plug into the socket.

8. The electrical plug-in connection according to claim 7, wherein the locking arms are arranged in a V-shape.

9. The electrical plug-in connection according to claim 7, wherein both of the locking arms are operable by the one operating element.

10. The electrical plug-in connection according to claim 1, wherein the plug is a cable plug which is fastened or fastenable to a cable, the socket is a chassis socket which is fastened or fastenable to a housing of a device, and the socket includes a mounting flange configured for fastening the socket to the housing of the device and an opening in the mounting flange through which the operating element passes.

11. The electrical plug-in connection according to claim 1, wherein the socket is directly or indirectly fastened to a printed circuit board.

12. The electrical plug-in connection according to claim 11, further comprising a carrier card, which is configured to be connected to the printed circuit board, and the plug-in extension receptacle is arranged on the carrier card.

* * * * *